US005894645A

United States Patent [19]

Hallis et al.

[11] Patent Number: 5,894,645

[45] **Date of Patent: *Apr. 20, 1999**

[54] METHOD OF FORMING A NON-TOXIC FRANGIBLE BULLET CORE

[75] Inventors: John M. Hallis, Buffalo; Richard W. Proulx, Forest Lake, both of Minn.

[73] Assignee: Federal Cartridge Company, Anoka, Minn.

[ * ] Notice: This patent is subject to a terminal disclaimer.

[21] Appl. No.: 08/905,152

[22] Filed: Aug. 1, 1997

[51] Int. Cl.[6] ..... B21K 21/06

[52] U.S. Cl. ..... 29/1.23; 29/1.22

[58] Field of Search ..... 102/398, 436, 102/439, 501, 506–510, 514–578, 474, 529; 29/1.2–1.23

[56] References Cited

U.S. PATENT DOCUMENTS

| | | | |
|---|---|---|---|
| 216,974 | 7/1879 | Rice . | |
| 914,992 | 3/1909 | Taylor . | |
| 1,892,152 | 12/1932 | Jones . | |
| 2,123,981 | 7/1938 | Whipple . | |
| 2,303,449 | 12/1942 | Fleischmann . | |
| 2,345,619 | 4/1944 | Moore . | |
| 2,762,108 | 9/1956 | Friedman . | |
| 2,958,115 | 11/1960 | Lyon . | |
| 2,958,287 | 11/1960 | Auxier . | |
| 3,003,420 | 10/1961 | Nosler . | |
| 3,097,603 | 7/1963 | Harper . | |
| 3,143,966 | 8/1964 | Burns, Jr. et al. . | |
| 3,173,371 | 3/1965 | Manshel . | |
| 3,208,386 | 9/1965 | Schneider et al. . | |
| 3,349,711 | 10/1967 | Darigo et al. . | |
| 4,949,645 | 8/1990 | Hayward et al. . | |
| 5,394,597 | 3/1995 | White . | |
| 5,454,325 | 10/1995 | LeBlanc . | |
| 5,528,989 | 6/1996 | Briese | 102/506 |
| 5,569,874 | 10/1996 | Nelson | 102/507 |
| 5,679,920 | 10/1997 | Hallis et al. | 102/506 |

FOREIGN PATENT DOCUMENTS

| | | |
|---|---|---|
| 72702 | 7/1894 | Germany . |
| 3819251 A1 | 12/1989 | Germany . |
| 3840165 A1 | 7/1990 | Germany . |
| B 902 864 | 11/1989 | Netherlands . |
| 11087 | of 1901 | United Kingdom . |

*Primary Examiner*—Harold L. Tudor
*Attorney, Agent, or Firm*—Schroeder & Siegfried P.A.

[57] ABSTRACT

A method of forming a frangible metal bullet core comprising providing an elongated inner heart member made up initially of a bundle of parallel zinc wires, twisting a plurality of zinc wires tightly around that bundle in a spiral path to cause the wires to inter-engage, deform and cohere to each other, and thereafter swaging the inter-engaged wires into the shape of a bullet core to cause the core, upon striking a target, to disintegrate into fragments smaller than the individual wires. Although copper, iron, and steel wires may be used, zinc made up of 99.99% pure zinc has been found to be preferable for forming such a core.

22 Claims, 3 Drawing Sheets

METHOD OF FORMING A NON-TOXIC FRANGIBLE BULLET CORE

This invention is related to our co-pending application for patent entitled NON-TOXIC FRANGIBLE BULLET, Ser. No. 08/510,747, filed Aug. 3, 1995, now issued as U.S. Letters Pat. No. 5,679,920 . The contents thereof are made a part hereof by reference thereto.

This invention is also related to an application, Ser. No. 08/885,887, entitled NON-TOXIC FRANGIBLE BULLET CORE, filed by the inventors of the instant application on Jun. 30, 1997, and directed to the disclosure and claims of the product manufactured by the methods defined and claimed hereinafter. The contents of said application are included herein by reference thereto.

BACKGROUND OF THE INVENTION

The background of the instant invention is the same as, or at least highly similar to, that set forth in our above allowed patent application, Ser. No. 08/510,747, filed Aug. 3, 1995, entitled NON-TOXIC FRANGIBLE BULLET. Consequently, the background material set forth in said allowed application is hereby repeated and included herein by reference thereto.

The background of the instant invention is the same as that set forth in our above pending, non-allowed patent application, in which we seek to obtain a patent on the product of manufacture which is produced as a result of practicing the method described and claimed hereinafter and, therefore, said background material is hereby repeated and included herein by reference thereto.

The method disclosed and claimed herein provides advantages not heretofore known. Substantial difficulty has heretofore been experienced in on-line manufacture of bullet cores, especially in the transfer of the raw slug into and within the swaging machine. The swaging machines most commonly in use require that the raw slug be presented within the swaging machine endwise to the forming die to be swaged while so oriented, where it is formed into a bullet core and then carried from the die to a forming machine which applies a copper jacket. Such orientation can best be performed by mechanically gripping one end of the slug, and thereafter moving same endwise into the confines of the swaging die. A mechanical gripper is provided in an effort to accomplish this function.

We have found that it is imperative that such a slug be well-defined and of firm construction, in order to avoid crumbling thereof while being so transferred within the swager and presented to and within the next forming die. The slug member is preferably initially prepared with dimensions approaching those of the desired bullet core, in order to minimize the extent of working of the metal which is required to reach the configuration and dimensions needed in the bullet core.

It is also desirable that at least one end of the slug be shaped and formed somewhat similar to the desired cylindrical trailing end of the bullet core to be formed. In order to facilitate adequate gripping thereof by the swaging machine during the gripping of one end thereof and the presentation to the forming die, we shape the raw materials into a core or rod. Without such prior shaping, the slug member will frequently be inadequately gripped by the gripping mechanism, and the slug member will be dropped and consequently not presented within the confines of the forming die, while interrupting the entire on-line manufacturing process.

The above problems have been experienced in the past in the swaging process utilized by the swaging machines commonly used. We have utilized the Model #250-C-SSS-D swaging machine formerly available from The E. J. Manville Machine Co., Inc., which is a 30-ton Press, Crank, Horizontal Swaging device, now available from Behr Machinery and Equipment Corporation, Box 740, Rockford, Ill., U.S.A.

Once the swaging of the slug member is completed, it is washed and coated with a corrosion inhibitor. Thereafter, it is desirable to mount the same within a copper jacket. To accomplish this purpose, we transfer the swaged slug member into a Waterbury Farrel, which is a machine for that purpose. We use the 6600 Special model which was formerly available from The Waterbury Farrel Foundry & Machine Co. and now is available from Waterbury Farrel Products, a division of Jones & Lamson, located at 750 West Johnson Avenue, Cheshire, Conn. 06410, U.S.A.

The swaged slug member is transferred from the swager to the above Waterbury Farrel, at which time the copper jacket is applied to the rear end of the swaged slug member, and the formation of the bullet core is completed by further compressing the swaged slug member within that copper jacket, to complete the formation of the bullet core. Thereafter, it is transferred into closing relation within the mouth of a brass casing having a propellant and primer therewithin, as is conventional, to complete the desired cartridge.

BRIEF SUMMARY OF THE INVENTION

The unique aspects of our invention include the concept and method of producing a substantially solid cable of a non-toxic metal having diametrical dimensions approaching those of a non-toxic, frangible bullet, a segment of which will not break up in the mechanical handling thereof, which is essential to on-line manufacture. We accomplish this by tightly winding wires of non-toxic metal in a clockwise direction around a central bundle of parallel wires which are also comprised of non-toxic metal as shown in FIG. 2, so as to form an elongated central heart which, together with said windings thereabout, approach the composition of a solid rod cable. These wires have been compressed only enough so that the twisted wires which envelope the bundle of similar wires, inter-engage and slightly deform each other and the wires of which the bundle is composed.

We have discovered that, when this relationship has been established, and the metal has thus been work-hardened appropriately by the swaging of said wires into the shape of a bullet core with sufficient pressure to cause the wires to further inter-engage and slightly deform while retaining at least some of their original physical boundaries, the wires comprising the bundle and the wires twisted therearound will, upon striking its target, break up into fragments which are substantially smaller than their original composition. These properties are highly desirable for safety purposes, when enclosed in bullets of training rounds used in the training of law enforcement personnel, or in other shooting ranges.

We find that, when said wires are made of an alloy having at least 95% zinc, and preferably of 99.99% zinc, upon striking their target, they will disintegrate into fragments much smaller than their original size, smaller than 12% of the original core size. It appears that the formation of the substantially all-zinc cable or rod, as described, and the subsequent swaging pressures, when combined with the working of the zinc caused by the impact of the bullet core upon its target, are adequate to cause the bullet core to become brittle, so as to break up into such small fragments. The self-annealing properties of zinc makes it possible to proceed with an on-line manufacture after the core has been swaged, without any delay. Thus, we can proceed with the additional handling and forming pressures needed to apply the copper jacket to the rear end of the swaged slug member, without interrupting the on-line manufacturing procedures.

Iron, steel, and copper do not have the full self-annealing properties of zinc and, as a consequence, a separate step of annealing may be necessary to be included after the swaging, in order to be practical and to proceed with the additional necessary mechanical handling and forming operations, if and when one of these three other metals are utilized.

The additional forming operations include the application of a copper jacket to the trailing end portion of the swaged heart and its encircling wires, and the subsequent forming of the jacket therearound into a tight securing fit. This copper jacket has a high copper content and will also break up into fragments when the finished bullet core strikes its target, as described above.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
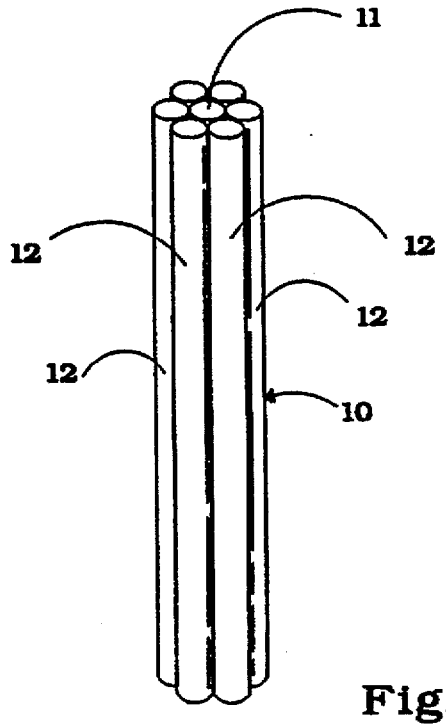
FIG. 1 is a perspective view of seven (7) zinc wires which constitute the heart of the bullet core of the preferred form of the invention, as initially assembled.

As previously indicated hereinbefore, the preferred method of forming a non-toxic frangible bullet core, in accordance with the invention, is disclosed in FIGS. 1–8. FIG. 1 shows a bundle 10 of straight parallel wires made of zinc, which are arranged with one 11 of the wires surrounded by six similar wires 12, so that their exterior surfaces come closest to defining a circular configuration around the central wire 11. This bundle 10 constitutes the heart of a zinc cable 13, which is formed by tightly wrapping a plurality of five zinc wires 14 around the bundle 10 at a angle approximating 33° to the longitudinal center of the bundle. These five wires 14 are drawn tightly enough around the bundle 10, so that the wires 14 inter-engage with each other and slightly deform each other. In addition, they engage each of the wires 12 under sufficient tension, so that they inter-engage and slightly deform the wires of the heart 10. As a result of the wires 14 being twisted around the bundle 10, the zinc cable or rod is formed. These wires are so tightly drawn that it is possible to cut segments off the cable or rod and to handle same thereafter, either manually or mechanically, without the wires losing their positions relative to each other. In other words, such a segment will not come apart or disintegrate as a result of such handling.

Figure 2:
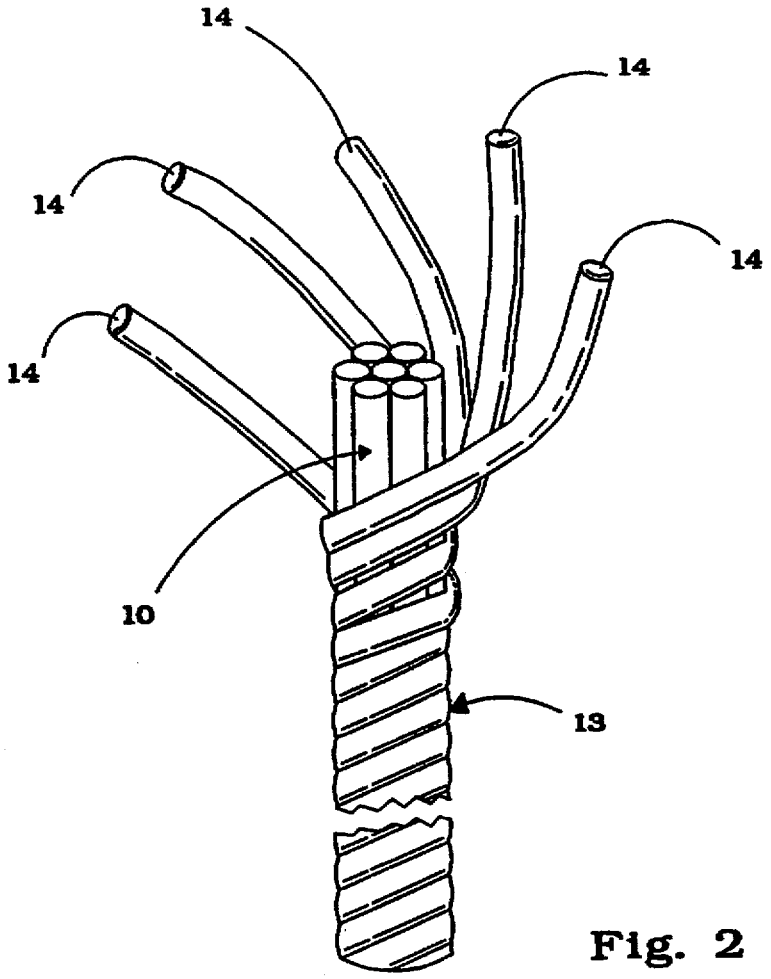
FIG. 2 is a perspective view showing the heart of the core of FIG. 1 having five (5) zinc wires of the same size as those in the heart, being wrapped tightly around the heart wires.

FIG. 2 shows the five wires 14 being wrapped around the bundle 10, as indicated hereinabove. The wires 14 are maintained under tension, as they are wrapped therearound.

Figure 3:
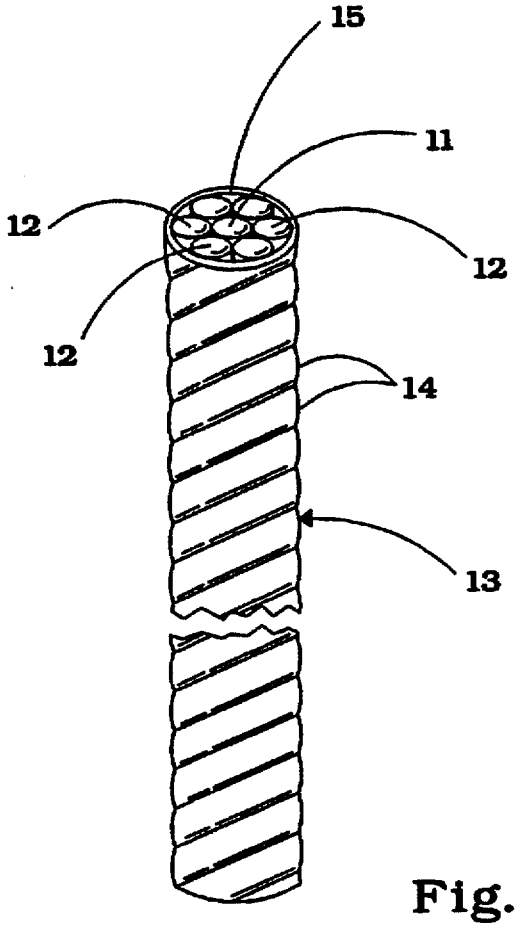
FIG. 3 is a perspective view of the cable as it appears when the operation shown in FIG. 2 is complete, with an intermediate section broken away.

FIG. 3 shows the cable 13 with a central portion as it appears when the terminal portion is severed from the main body of the cable. It will be seen that the wires 14 form a sheath or jacket around the bundle 10, which functions to hold the bundle 10 in compact fixed relation to the sheath 15, which is comprised of the five zinc wires 14.

Figure 4:
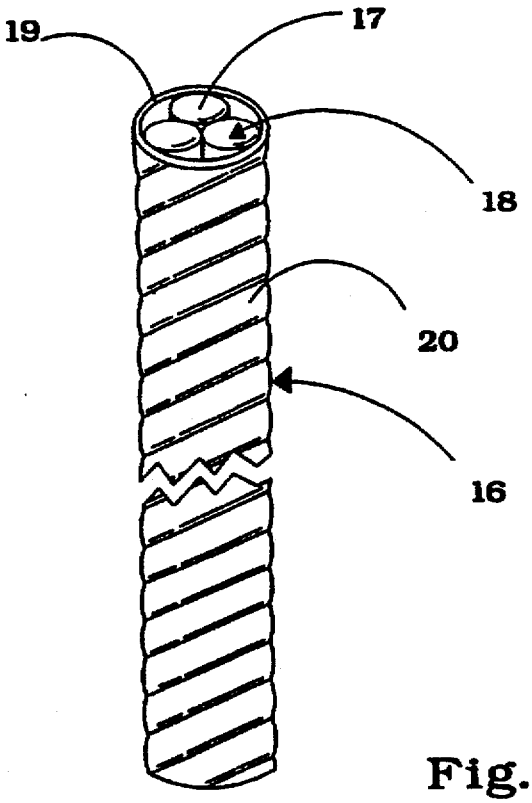
FIG. 4 is a perspective view of a cable similar in size to that of FIG. 3 but having a heart comprised of only three (3) parallel central wires.

FIG. 4 shows a cable 16 formed in the same manner as cable 13, with the exception that three parallel wires 17 comprise the bundle, which comprises the heart 10, which is encased within a similar sheath 19, which is comprised of five wires 20, each of which is similar to the wires 14. The only difference between the cables 13 and 16 is that the bundle 18 is comprised of three zinc wires which are slightly larger in diameter than the diameter of the wires or strands 12. Either of the two cables 13 or 16 will function adequately to furnish slugs which may be cut therefrom and swaged into a non-toxic frangible bullet core, as described hereinafter.

As the formation of the cable 13 or 16 is completed, it is fed in line into a swaging machine for the purpose of cutting a segment off the cable of a size appropriate for the dimensions of the bullet core to be formed. We utilize the Model No. 250-C-SSS-D Swaging Machine, formerly manufactured by The E. J. Manville Machine Co., Inc., which is a 30-ton Press, Crank, Horizontal Swaging Device, now available from Behr Machinery and Equipment Corporation, Box 740, Rockford, Ill., U.S.A. This machine will cut a segment off the cable of an appropriate length (generally slightly longer than the desired core), to which it may be set, and mechanically grips one end of that segment and then presents the same to the swaging die of the machine.

Figure 5:
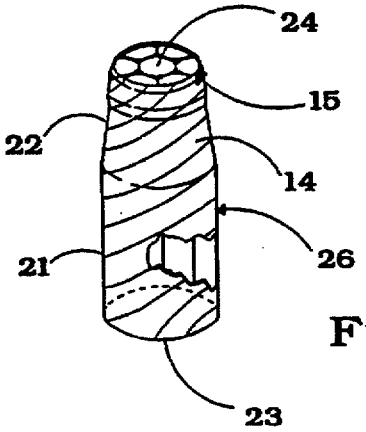
FIG. 5 is a perspective view of a bullet core embodying the invention prior to the application of the copper jacket thereto.

The above swaging machine then proceeds to swage the segment of cable by compressing it longitudinally into the desired soft-nose shape and size of the desired bullet core. This swaging operation compresses the segment of the cable 13 or 16, as the case may be, to such an extent that the exterior wires 14 and the wires of the heart 10 are further inter-engaged and deformed into a composite shape, such as is shown in FIG. 5. It will be seen that the general outline of the bullet core has, at this stage, been formed, in that it has a cylindrical rear portion 21 which tapers inwardly, as at 22, towards its forward or nose end, and tightly encases the heart 10. As shown, the core has a rear end 23 and a forward or nose end 24. It will also be seen that the individual zinc wires 14 retain their original physical individuality, at least to a limited extent, which is discernible to the naked eye. It is estimated that approximately 90 to 95% of the inter-engagement and deformation of the outer wires 14 of the sheath 15 and the wires of the heart 10 is accomplished in this swaging operation. It is estimated that approximately 5–10% of the inter-engagement and deformation of said wires is accomplished in the initial formation of the cable or rods 13 and 16, as hereinbefore described.

Figure 6:
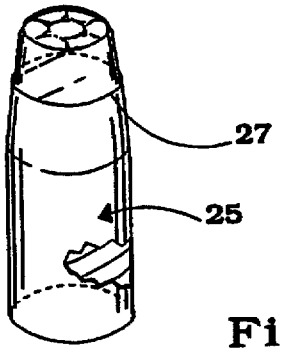
FIG. 6 is a perspective view of the complete bullet core embodying the invention.

Once the swaging described hereinabove has been completed, the basic core configuration, as shown in FIG. 5, is mechanically transferred to the final formation station, which consists of a Waterbury Farrel Machine, which is designed to apply a copper jacket 25 to the basic zinc core 26, as shown in FIG. 6. As shown in FIG. 6, the rear end 23 of the core 26 is introduced into the open end 27 of the jacket 25. We utilize a Waterbury Farrel Machine, the 6600 Special model, which was formerly available from the Waterbury Farrel Foundry & Machine Co., and is now available from Waterbury Farrel Products, division of Jones & Lamson, located at 750 West Johnson Avenue, Cheshire, Conn. 06410, U.S.A. Here the copper jacket is applied to the rear end of the swaged slug member 26, and the formation of the bullet core is completed by further compressing the swaged slug member 26 within that copper jacket 25, to complete the formation of the bullet core. The basic core 26 and copper jacket 25 are compressed, so as to cause the jacket 25 to fit tightly and securely around the rear end portion of the basic bullet core 26. This completes the formation of the non-toxic frangible bullet 28, which is shown in FIG. 8 mounted within the mouth 29 of a brass cartridge casing 30, in the conventional manner utilized in the manufacture of a cartridge.

Figure 7:
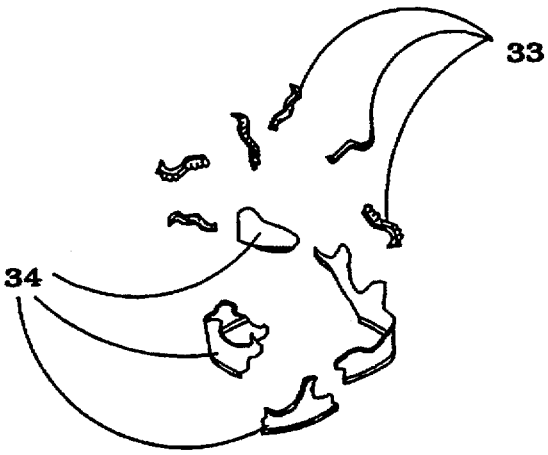
FIG. 7 is a perspective view showing the degree of fragmentation of the bullet core embodying the invention, upon impact with its target.
Figure 8:
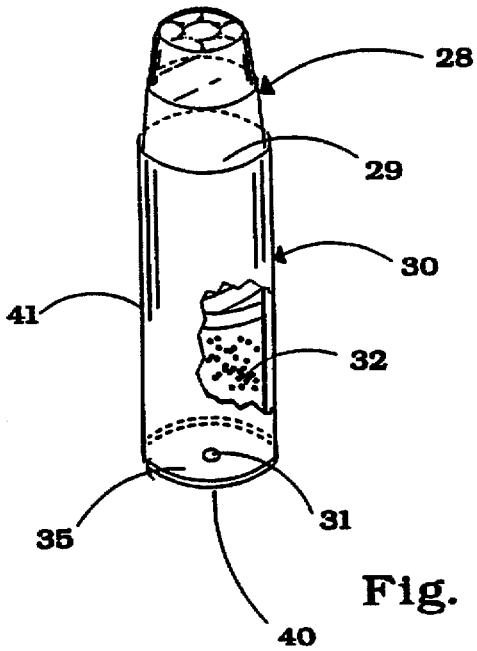
FIG. 8 is a perspective view, with portions broken away, showing a bullet core embodying the invention, mounted within a centerfire brass casing.

As shown in FIG. 8, the brass casing 30 has an open mouth 29, a primer 31, and propellant 32 therewithin. The propellant is located in close proximity to the primer 31, so that it will be fired upon detonation of the primer 31, and the bullet 28 will be expelled by the ignited propellant 32 from the open mouth 29 of the cartridge. As suggested hereinbefore, it is believed that the working of the zinc wires 12 and 14, of the segment of cable 13, work-hardens the zinc material from which said wires are made, but the self-annealing properties of zinc enables the manufacturing process to continue without interruption or an additional annealing step. In addition, it is believed that the effect of the impact of the bullet core, when it strikes its target, again work-hardens the zinc sufficiently, so as to make it adequately brittle to cause the same to disintegrate and break up into fragments which are substantially smaller than any of the initial wires. This is best shown in FIG. 7, in which the small fragments of wire and of the copper jacket are depicted. It will be seen therefrom that the fragments of zinc identified by the numeral 33 show the effects of the inter-engagement and deformation thereof resulting from the swaging and the formation of the cable 13, when the wires 14 are tightly wrapped around the bundle or heart 10. It will be seen also that the copper jacket 25 has fragmented into fragments 34. We have swept the interior of a shooting range for bullets manufactured in accordance with the invention herein, and have found no fragment of a size exceeding 12% of the initial size of the original bullet core. Most, if not all, of the particles are substantially smaller than 12% of the initial size of the original bullet core.

It will be seen, by reference to FIGS. 3–8, that the wires of the central core or heart 10 of the cables 13 and 16 extend throughout the length of the core. We have found that each strand of the heart is deformed and inter-engaged with the outer strands of wire 14.

We prefer to utilize zinc wires which are 99%–99.99% zinc, for it appears that the higher zinc content facilitates the disintegration of the individual strands into the much smaller fragments. The preferred range of zinc which we utilize is 99.99% zinc, which is the purest form of zinc which is available, the balance being in the form of impurities. It is believed that the minimum percentage of zinc to be utilized, in the form of an alloy, is approximately 95% zinc.

As shown in FIG. 8, the casing 30 has a mouth 29, a head 35, a rim 40, and a main body portion 41.

The non-toxic frangible bullet core described hereinabove has highly desirable physical characteristics in that it disintegrates into relatively small fragments, when the bullet core strikes its target, as hereinbefore indicated. The advantage of such a bullet core lies in the fact that the fragmentation of the core, at the point of impact, has proved to eliminate the dangers and disadvantages of bounce-back, ricochetting, and errant penetration, as hereinbefore described. When bullet cores having the properties outlined herein are utilized, there is no real danger or disadvantage connected therewith with respect to these problems. In addition, since zinc is non-toxic, there is no problem of a toxic-containing atmosphere within the shooting range, which heretofore has been created by the firing of lead bullets.

In addition to the above, a manufacturer of a bullet core, as disclosed and claimed herein, offers very distinct advantages in that the practice of utilizing on-line manufacturing of the bullet cores is feasible and cost-effective, since the segment of the cables 13 and 16 are structurally compact and capable of being handled mechanically, without crumbling or otherwise disintegrating, so that it is now possible for the forming machines to operate satisfactorily on an on-line basis. We have found that the segment of the cables 13 or 16 can be gripped positively with the swaging machine immediately subsequent to the cutting of the segment of the cable, so that it can be effectively and safely transferred mechanically to a position where the forward end of the segment is presented to the swaging die in a longitudinally oriented position. As a result thereof, a serious problem of manufacture has been overcome, so that an on-line manufacture of such non-toxic frangible bullet cores has been made possible, without serious handling problems of the segments from which bullet core is to be manufactured.

It will, of course, be understood that various changes may be made in the form, details, arrangement and proportions of the parts without departing from the scope of the invention which comprises the matter shown and described herein and set forth in the appended claims.

Wherever herein the term soft-point nose is utilized, it is intended to connote a core which has a cylindrical rear portion and extends forwardly beyond the jacket and slopes inwardly toward the forward end of the nose, which is smooth.

We claim:

1. A method of forming a frangible metal bullet core comprising:

(a) providing an elongated inner heart member made of strands of zinc which will self-anneal subsequent to being work hardened and having opposite ends;

(b) providing a plurality of separate strands made of zinc which will also self-anneal subsequent to being work hardened;

(c) twisting the separate strands tightly around the inner heart member along a spiral path in inter-engaging, deforming and encircling relation therewith prior to being swaged, and (d) swaging the inter-engaged inner heart member and the encircling strands into the shape of a bullet core with sufficient pressure to retain the individuality of the encircling strands at least to a limited extent, whereupon the core, upon striking a target, will disintegrate into fragments smaller than the original size of the encircling strands.

2. The method of forming a frangible bullet core as defined in claim 1, wherein the inner heart member and the encircling strands are swaged into a bullet core having a soft-point nose.

3. The method of forming a frangible bullet core as defined in claim 1, wherein the heart member is originally comprised of a plurality of zinc wires arranged in substantially parallel relation.

4. The method of forming a frangible bullet core as defined in claim 1, wherein the encircling zinc strands are twisted around the heart member along a spiral path.

5. The method of forming a frangible bullet core as defined in claim 1, and limiting the pressure utilized in the swaging step to cause the components of the heart member and the encircling strands to retain their individuality at least to a limited extent and to disintegrate along at least some of their original physical boundaries.

6. The method of forming a frangible bullet core as defined in claim 1, wherein the encircling strands are twisted around the heart member along a spiral path from one end of the heart member to its other end.

7. The method of forming a frangible bullet core as defined in claim 1, and swaging the encircling strands and the heart member with sufficient pressure to deform the components thereof relative to each other while retaining at least some of their original physical boundaries.

8. The method of forming a frangible bullet core as defined in claim 1, wherein the heart member extends throughout the length of the bullet core.

9. A method of forming a highly frangible metal bullet core for use in a training round in training exercises for law enforcement personnel, comprising:

a. providing an elongated inner heart member made of substantially parallel strands of zinc;

b. providing a plurality of separate strands made of zinc;

c. twisting the separate strands tightly around the inner heart member in inter-engaging, deforming and encircling relation therewith prior to being swaged, and d. thereafter swaging the inner heart member and the encircling strands into the shape of a bullet core having a soft-point nose and a cylindrical rear portion, with sufficient pressure to cause the inner heart member and the encircling strands to further inter-engage and deform each other while retaining the individuality of the encircling strands at least to a limited extent, whereupon the core, upon striking a target, will disintegrate into fragments smaller than the original size of the encircling strands.

10. The method of forming a frangible bullet core as defined in claim 9, wherein the inner heart member which is provided is comprised of a plurality of separate zinc wires arranged in substantially parallel relation.

11. The method of forming a frangible bullet core as defined in claim 9, wherein the inner heart member which is provided consists initially of a group of seven (7) substantially parallel zinc wires.

12. The method of forming a frangible bullet core as defined in claim 9, wherein the inner heart member which is provided is comprised initially of a group of seven (7) substantially parallel zinc wires, and the separate strands which are provided are five (5) in number.

13. The method of forming a frangible bullet core as defined in claim 9, wherein the inner heart member which is provided consists of a group of at least three (3) substantially parallel zinc wires.

14. The method of forming a frangible bullet core as defined in claim 9, wherein the inner heart member which is provided extends throughout the length of the bullet core.

15. The method of forming a frangible bullet core as defined in claim 9, wherein the inner heart member which is provided extends longitudinally within the bullet core coextensively with the encircling strands.

16. A method of producing a non-toxic frangible bullet core comprising:

(a) assembling a bundle of parallel wires made of zinc or a zinc alloy and having forward and rear ends;

(b) twisting a plurality of wires made of zinc or a zinc alloy around the bundle at an acute angle thereto in tight, encircling, inter-engaging and deforming relation from the rear to the forward ends of the bundle, to form a compact cable of zinc or zinc alloy having a diameter approaching that of the desired bullet core;

(c) severing a segment of the cable having a length slightly greater than the length of the desired bullet core; and (d) swaging the segment of cable into the shape of a bullet core with sufficient pressure to cause the encircling wires to further inter-engage and deform their original physical boundaries, but to retain their physical boundaries at least to a limited extent, whereupon the core will disintegrate, upon striking a target, into fragments smaller than the original size of the individual encircling wires.

17. The method defined in claim 16, wherein the zinc wires are comprised of 95–99.99% zinc.

18. The method defined in claim 16, wherein the zinc wires are comprised of at least 95% zinc.

19. The method defined in claim 16, wherein the zinc wires are comprised of approximately 99.99% zinc.

20. The method defined in claim 16, wherein the zinc wires are comprised of 99–99.99% zinc.

21. The method defined in claim 16, wherein the zinc wires are comprised of at least 99% zinc, and the plurality of wires are twisted around the bundle in a spiral direction.

22. The method defined in claim 16, and affixing a copper jacket to one end portion of the cable segment.

* * * * *